US012035786B2

(12) United States Patent
Iles

(10) Patent No.: US 12,035,786 B2
(45) Date of Patent: Jul. 16, 2024

(54) MODULAR JEWELRY SYSTEM

(71) Applicant: Nina Iles, Lafayette, CO (US)

(72) Inventor: Nina Iles, Lafayette, CO (US)

( * ) Notice: Subject to any disclaimer, the term of this patent is extended or adjusted under 35 U.S.C. 154(b) by 323 days.

(21) Appl. No.: 17/054,627

(22) PCT Filed: May 11, 2018

(86) PCT No.: PCT/US2018/032269
§ 371 (c)(1),
(2) Date: Nov. 11, 2020

(87) PCT Pub. No.: WO2019/216911
PCT Pub. Date: Nov. 14, 2019

(65) Prior Publication Data

US 2021/0068506 A1 Mar. 11, 2021

(51) Int. Cl.

| | |
|---|---|
| ***A44C 13/00*** | (2006.01) |
| ***A44C 5/20*** | (2006.01) |
| ***A44C 7/00*** | (2006.01) |

(52) U.S. Cl.
CPC ..... *A44C 13/00* (2013.01); *A44C 5/2009* (2013.01); *A44C 7/002* (2013.01)

(58) Field of Classification Search
CPC ..... A44C 5/00; A44C 7/002; A44C 13/00; A44C 15/001; A44C 25/00; A44C 25/001; A44C 25/007
USPC ..... 63/40
See application file for complete search history.

(56) References Cited

U.S. PATENT DOCUMENTS

| | | | | |
|---|---|---|---|---|
| D263,288 | S | 3/1982 | Errigo | |
| 4,763,489 | A | 8/1988 | Strong | |
| 4,781,038 | A | 11/1988 | Branca et al. | |
| 9,408,442 | B1 | 8/2016 | Terry et al. | |
| 9,894,965 | B2 * | 2/2018 | Edmonston | A44C 15/005 |
| 2010/0030719 | A1 | 2/2010 | Covey et al. | |
| 2012/0240623 | A1 | 9/2012 | Morse | |
| 2015/0359301 | A1 | 12/2015 | Lavorato et al. | |
| 2016/0051015 | A1 | 2/2016 | Powers | |
| 2019/0090598 | A1 * | 3/2019 | Aaron | A44C 7/002 |

FOREIGN PATENT DOCUMENTS

WO 2012046045 A2 4/2012

OTHER PUBLICATIONS

EP Extended Search Report in Application No. 18918368.4 dated Nov. 30, 2021, 7 pages.
International Search Report dated Sep. 11, 2018 in International Application No. PCT/US2018/032269, 3 pages.

* cited by examiner

*Primary Examiner* — Jack W Lavinder
(74) *Attorney, Agent, or Firm* — Berg Hill Greenleaf Ruscitti LLP

(57) ABSTRACT

The invention generally includes a modular jewelry system that may include a plurality of interchange components allowing a user to create a personalized jewelry item. In certain embodiment, jewelry components may be interchangeable across a variety of jewelry pieces allowing for improved user customization and personalization based on size, shape, color and design.

17 Claims, 2 Drawing Sheets

MODULAR JEWELRY SYSTEM

CROSS REFERENCE TO RELATED APPLICATION

This application is a national stage application under 35 U.S.C. 371 of PCT Application No. PCT/US2018/032269, having an international filing date of May 5, 2018. The entire application and specification of that application is incorporated by reference in its entirety.#

TECHNICAL FIELD

The present relates to a modular jewelry system that may include a variety of interchangeable elements that may be coupled together to form a variety of customized jewelry pieces.

BACKGROUND OF THE INVENTION

Jewelry items such as earrings and bracelets are typically made using precious and/or semi-precious metals, such as gold or silver, and often incorporate one or more precious or semi-precious stones, such as diamonds, to enhance the items' appearance. Because such jewelry items are expensive, often one must choose to buy one or another in order to stay within "budget". However, depending on the occasion or event, it may be preferable to wear earrings as opposed to a bracelet, or vice versa. Furthermore, earrings often fall our and/or get lost (the tendency being to lose one earring only), rendering the remaining earring totally useless. Accordingly, it would be desirable to provide a modular jewelry system item that is configured to be interchangeable, and therefore adaptable to a variety of jewelry pieces as well as practical wearable applications.

As such, there has long been a need for more versatile uses of jewelry. One means of accomplishing this end, is with the use of interchangeable jewelry pieces. Numerous traditional techniques exist for making jewelry items having aesthetically desirable characteristics. For example, others in the past have attempted to allow more consumer versatility in jewelry by creating necklace charm/ornament holders, spacer beads, and the like.

For example, a common practice in the market to facilitate the wearing of one or more charms/ornaments was the charm holder as an attachment to a necklace. This enabled the wearer to change charms as chosen by removing or adding pieces on the charm holder. However, this provided versatility for necklaces only and if more than one ornament was placed on the holder. Another common practice to provide an even spacing of charms/ornaments were the use of spacer beads on the neck chain itself or the charm holder mentioned above. This tended to solve the problem of a member of charms clumping in a group on the chain or charm holder, and provided a more aesthetic presentation, but limited versatility. For example, U.S. Pat. No. 4,783,974 to Hernandez (1988) discloses a method to interchange ornaments for earrings and necklaces using a clutch-breakaway system separating at one pound or less of pressure, however this type of mechanism could be disengaged easily creating a probability of loosing the jewelry pieces.

Other attempts to provide the consumer with a method of interchangeability for jewelry heretofore, suffer a number of disadvantages, namely 1) The lack of a complete and universal method of interchangeability that provides functionality, versatility, and aesthetic presentation.

2) Methods to date fail to provide an uniform, all encompassing system applicable to all types of jewelry (pins, necklaces, earrings, bracelets, etc).
3) If the consumer chooses to use more than one charm/ornament on a necklace using the charm holder or spacer beads, this results in a cluttered presentation.
4) Methods available to the consumer to date provide only limited creativity.
5) An interchangeable mode of operation of the clutch-breakaway type, would facilitate the possibility of having pieces detached with a very minimal pulling effort resulting in loss of pieces and the consumers investment in the jewelry.

As such, there exists a need for a modular jewelry system that addresses the limitations outlined above. The invention described generally herein relates to a modular jewelry system which may be applied to a variety of jewelry pieces, i.e. necklaces, bracelets, earrings and the like, and overcomes the limitations outlined above to encompass a truly practical, cost-effective, and aesthetically pleasing modular jewelry system.

SUMMARY OF THE INVENTION

The inventive technology generally relates to systems, methods, and compositions for a modular jewelry system that may be customizable through a plurality of modular components that may be customizable by a user based on design preferences.

One aim of the invention may include the generation of a modular earring system. In this embodiment, modular earring system may include a first earring base that may be structurally configured to secure one or more decorative inserts. These decorative inserts may be secured in a jacket that may further have one, or even a plurality of jacket couplers. This inventive modular earring system may further include a second earring base, generally comprising a decorative insert secured in a jacket. This second earring base may have a jacket attachment that may be configured to be secured with a jacket coupler on the first jacket. This second earring base may further include a jacket having a second jacket coupler that may be coupled with one or more additional customizable earring bases.

Another aim of the invention may be to generate a modular bracelet system. In this embodiment, a bracelet, necklace or any strung-jewelry piece, may have a bracelet coupler that may further be configured to secure one or more bails. In a preferred embodiment, this bail may be configured to be coupled with the bail and further coupled with a bracelet coupler forming a modular bracelet attachment.

Another aim of the current invention may include the generation of an interchangeable modular jewelry system. In this embodiment, a first earring base may be configured to secure one or more decorative inserts in a first jacket. This first jacket may further be configured to have a first jacket coupler that may be coupled with a second earring base through a jacket attachment. In this embodiment, a bracelet, or necklace of any strung jewelry piece may be configured to form a modular bracelet attachment with said second earring base. Here, a bracket coupler may be secured to a bracelet, or necklace, and further be coupled with a bail that maybe configured to be hold and/or secure a second earring base that may be removed from a modular earring.

Additional aims of the inventive technology will be evident from the detailed description and figures presented below.

MODE(S) FOR CARRYING OUT THE INVENTION(S)

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1A:
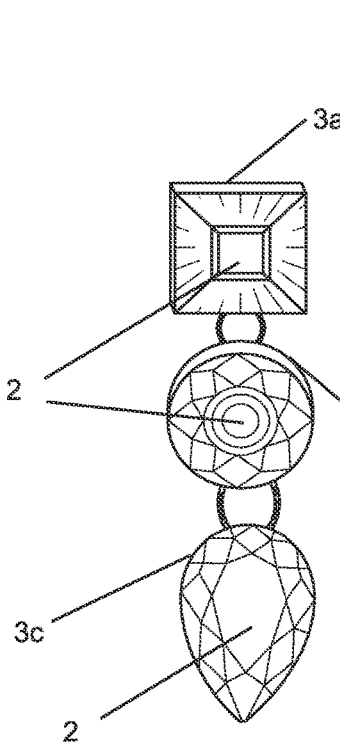
FIG. 1A—demonstrates a modular earring system in one embodiment having an earring base coupled with a first jack which is further coupled with a second jacket in one embodiment thereof, FIG. 1B—demonstrates a modular earring system in one embodiment having a detachable hoop earring base coupled with a first jack which is further coupled with a second jacket in one embodiment thereof, FIG. 1C—demonstrates a rear view of a modular earring system in one embodiment having an earring base coupled with a first jack which is further coupled with a second jacket in one embodiment thereof, FIG. 2A—demonstrates a bail that may be used in a modular bracelet system in one embodiment thereof.
Figure 1B:
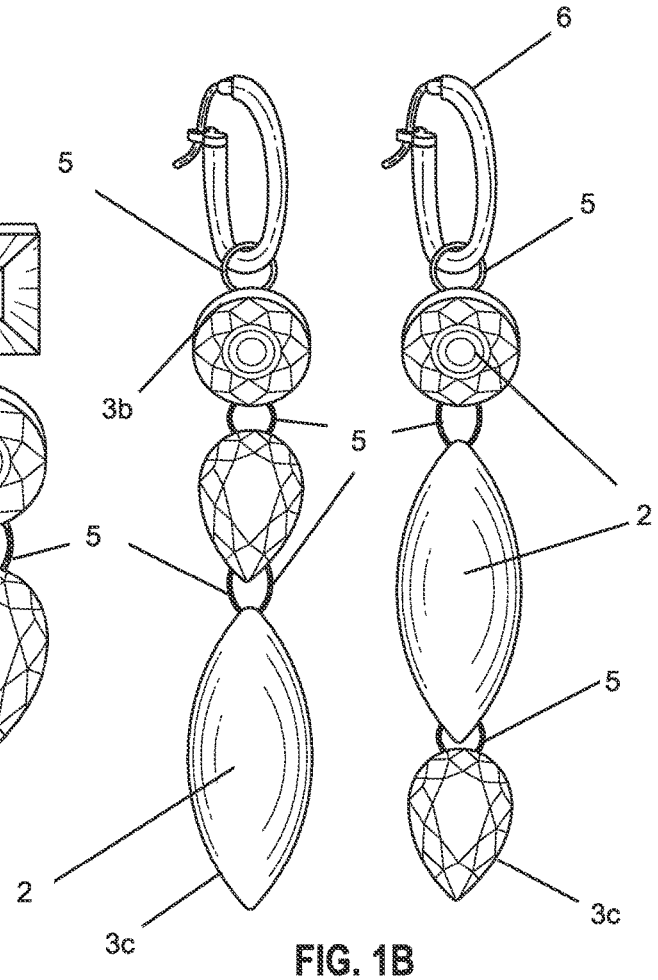
Figure 1C:
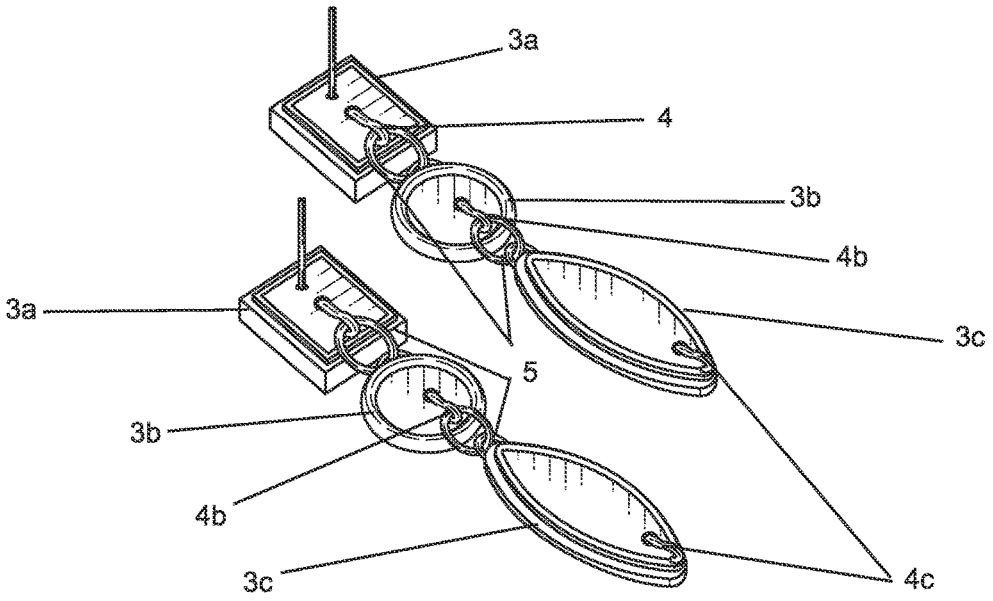

Generally referring to FIGS. 1A-C, the present invention may include a modular earring system. In one preferred embodiment, this modular earring system may include an earring base (1) that may be configured to be attached to a typical user's earlobe, or other pierced appendage. Such an earring base (1) may be attached to a typical user's earlobe, or other pierced appendage through a pin, hook, clamp or other similar component. In this preferred embodiment, an earring base (1) may be formed from a jacket (3) that may be further configured to secure one or more decorative inserts (2). As shown in FIG. 1C, a jacket (3) may be formed from a metal frame having a back—and/or side-wall configured to hold one or more decorative inserts (2). These decorative inserts (2), as demonstrated, may include a variety of shapes, and/or colored materials. For example, in certain embodiments such decorative inserts (2) may include, but not be limited to: gemstones, replica gemstones, glass, plastic, or other decorative ornament and the like. These decorative inserts (2) may be secured to a jacket (3), through a snap-fit coupling, or an adhesive, or other clamp or coupling device or component. In other embodiments, a clasped hoop (6) may be used to attach a modular earring to a user's ear or other pierced appendage as generally shown in FIG. 1.

In certain embodiment, a jacket (3) may include a jacket coupler (4), which may also be identified as a second jacket coupler (4*b*), that may be a component configured to be capable of securing a second jacket (3*b*). As shown in FIG. 1C, in one preferred embodiment, a jacket coupler (4) on a first jacket (3*a*) may include an integral clasp, or a clasp that is integral with the jacket structure. Non-integral clasps may also be included in the invention. Examples may include one or more clasps that may be coupled with a jacket, for example through a soldered connection.

In either of these embodiments, the jacket coupler (4), which in this case may be a clasp, and can be configured to secure a jacket attachment (5) on a second jacket (3*b*). In this embodiment, a jacket attachment (5) may include an integral, or non-integral components extending outward from a jacket (3), and may further be configured to be mated with jacket coupler (4). As demonstrated in FIGS. 1B-C, in a preferred embodiment, a jacket (3) may include a jacket coupler (4) configured as an extended integral hoop that may be configured to secure one or two elements together. Naturally, various coupling components and/or mechanisms maybe used to couple and/or secure one or more jackets together. Such examples may include, but not be limited to: snap couplers, slide couplers, magnetic couplers, beveled couplers, pin-hole couplers and the like.

Referring again generally to FIG. 1, a second jacket (3*b*) may include a jacket coupler (4), which in this embodiment may be identified as a second jacket coupler (4*b*), that may be configured to be capable of securing a jacket attachment (5) on a third jacket (3*c*). In this embodiment, the coupling is in-series, thus generating a liner modular earring that may be extended in generally the same manner as above. Additional embodiments may include non-liner or non-series couplings. Indeed, as generally shown by the modular nature of the invention, a jacket (s) may include a plurality of jacket couplers (4) and/or jacket attachments (5) positioned a various points along the jacket to form in-series, parallel, stacked and/or angled configuration. In still further embodiment, such jacket couplers (4) and/or jacket attachments (5) may coupled with extenders and other devices to form breaks in the design configuration.

Figure 2A:
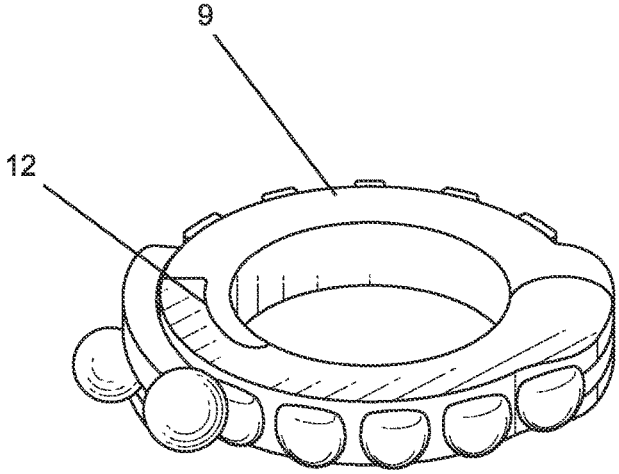
FIG. 2B—demonstrates a bracelet coupler that may be used in a modular bracelet system in one embodiment thereof.
FIG. 2C—demonstrates a modular bracelet system in one embodiment thereof.
Figure 2B:
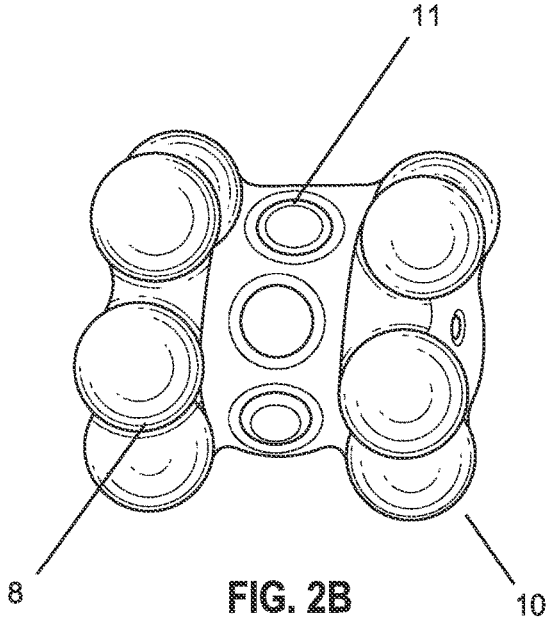
Figure 2C:
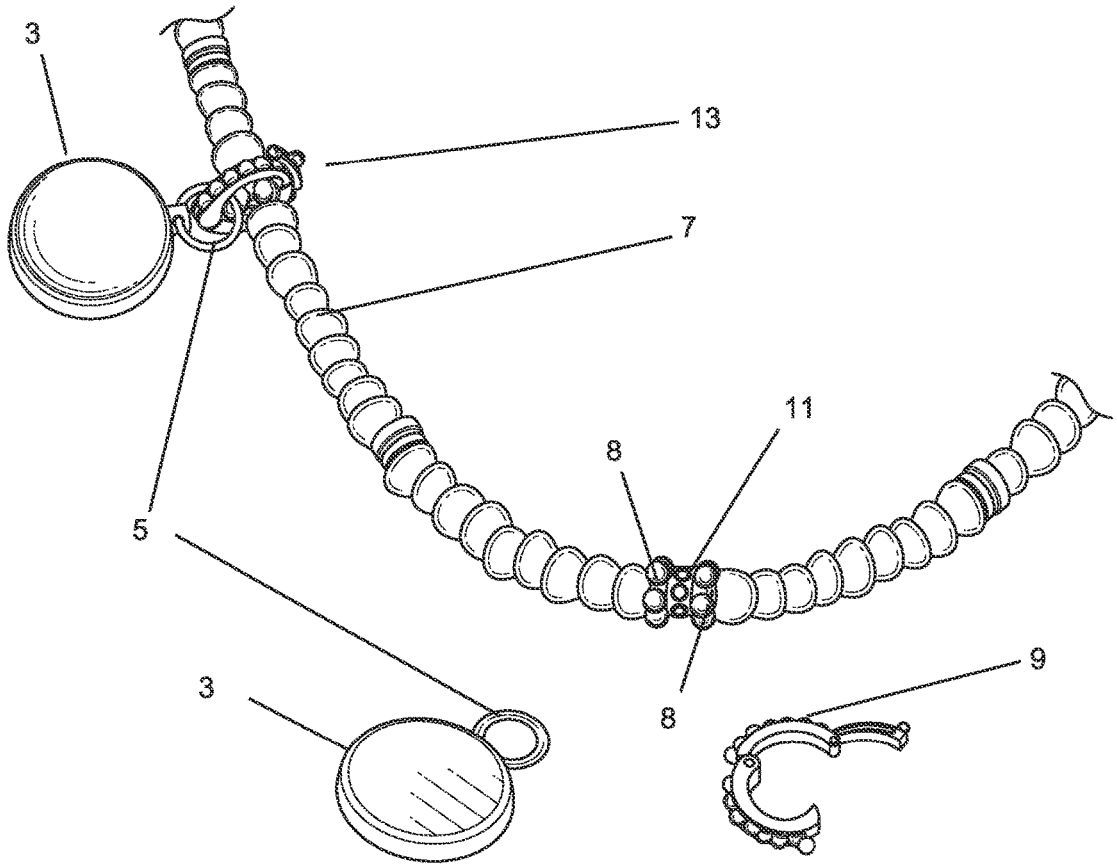

In certain embodiments, the invention may include a modular bracelet system. In the preferred embodiment shown in FIGS. 2A-C, a bracket (7) may be configured to be secured with a bracelet coupler (8). Specifically, as shown in FIG. 2C, a bracelet coupler (8) may include an aperture where the bracelet may be threaded. One or more bracelet couplers (8) may be secured to a bracelet (7) and may be retained through additional bracelet ornamentations as shown in FIG. 2C. It should be noted that in some instances a bracelet may be used as an anklet, while additional embodiments, a bracelet may be replaced with a necklace or other strung-jewelry pieces. As such, the term bracelet may embody any strung-jewelry piece.

In one embodiment, a bracelet coupler (8) may be configured to be coupled with a bail (9). As demonstrated in FIG. 2B, in one preferred embodiment, a bail (9) may be positioned with a bail groove (11) on the bracelet coupler (8). In this embodiment, the lateral edges of a bail groove (11) may be formed by a raised bail stopper surface (10) on either side of a bail groove (11). In this configuration, a bail (9) may be secured bracelet coupler (8) and may be freely rotatable around the bail groove (11). As noted in FIG. 12, a bail (9) may include a bail lock (12) that may be engaged to secure the bail (9) in the bail groove (11). In certain embodiment, this bail lock (12) may include a clamp; while in other embodiments may include a fitted lock, a snap lock, a slide lock and the like.

In one embodiment, the invention may include a modular configuration such that one or more jackets (3) may be coupled with a bail (9) that may be further secured to a bracelet coupler (8) forming a modular bracelet attachment (13). In the preferred embodiment shown in FIG. 2C, a bracelet coupler (8) may be secured o a bracelet (7). A bail (9) may hold a jacket (3) through, in this embodiment a jacket attachment (5), and may be secured around a bail groove (11) on the bail. As noted above, in this embodiment a jacket (3) may include one or more jacket couplers (4) that may be configured to secured additional jackets (4) forming a modular jewelry systems. As one can also note, it may be possible in certain embodiments to transfer a jacket (4) from a modular earring system, to a modular bracelet system.

While the invention has been described in connection with a preferred embodiment, it is not intended to limit the scope of the invention to the particular form set forth, but on the contrary, it is intended to cover such alternatives, modifications, and equivalents as may be included within the spirit and scope of the modular jewelry system as defined by the statements of invention. Indeed, as can be easily understood from the foregoing, the basic concepts of the present invention may be embodied in a variety of ways. It involves modular jewelry system designs, devices and methods to manufacturer the same. In this application, the modular jewelry system designs, devices and methods of manufacture, are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action.

Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "method for manufacturing a coupler or coupling structure." Such changes and alternative terms are to be understood to be explicitly included in the description.

Any patents, publications, or other references mentioned in this application, for example through a concurrently or later submitted Information Disclosure Statement, are hereby incorporated by reference. Any priority case(s) claimed by this application is hereby appended and hereby incorporated by reference. Thus, the applicant(s) should be understood to have support to claim and make a statement of invention to at least: i) each of the devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application.

Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this phrase also provides support for any combination of elements in the claims and even incorporates any desired proper antecedent basis for certain claim combinations such as with combinations of method, apparatus, process, and the like claims.

Furthermore, it should be noted that certain embodiments of the current invention may indicate a coupler, or the step of coupling or two or more items that may be coupled. It should be noted that these may indicate a direct, or in some cases an indirect connection and/or bring together of disparate or non-disparate elements in a functional, non-functional or desired configuration.

Additionally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A modular jewelry system comprising:

a plurality of earring bases each securing one or more decorative inserts in a jacket, wherein each of the plurality of earring bases comprises at least one of a jacket attachment comprising an integral hoop, and a jacket coupler, wherein said plurality of earring bases can be coupled in-series to form a linear modular earring; and a bracelet or necklace having at least one modular attachment comprising:

at least one second coupler configured to be secured to said bracelet or necklace;

at least one bail configured to be secured around said at least one second coupler.

2. A modular jewelry system as described in claim 1 wherein said jacket coupler comprises an integral clasp.

3. A modular jewelry system as described in claim 1 wherein said one or more decorative inserts comprises a decorative insert selected from the group consisting of: a gemstone, a replica gemstone, a glass insert, a plastic insert, an ornament.

4. A modular jewelry system comprising:

a first earring base configured to secure one or more decorative inserts in a first jacket and wherein said first jacket is configured to have a first jacket coupler;

a second earring base configured to secure one or more decorative inserts in a second jacket wherein said second jacket is configured to have a jacket attachment configured to be secured with said first jacket coupler and have a second jacket coupler;

a bracelet;

at least one modular bracelet attachment comprising:

at least one bracelet coupler configured to be secured to said bracelet;

at least one bail configured to be secured around said bracelet coupler; and wherein said second jacket can be de-coupled from said first earring base and be coupled with said bail through said jacket attachment.

5. A modular jewelry system as described in claim 4 wherein said first earring base configured to be coupled with a second earring base comprises a clasped hoop.

6. A modular jewelry system as described in claim 5 wherein said first jacket coupler comprises an integral clasp.

7. A modular jewelry system as described in claim 6 wherein said jacket attachment comprises an integral hoop configured to be coupled with said integral clasp.

8. A modular jewelry system as described in claim 7 wherein said one or more decorative inserts comprises a decorative insert selected from the group consisting of: a gemstone, a replica gemstone, a glass insert, a plastic insert, an ornament.

9. An interchangeable modular jewelry system comprising:

a first earring base configured to secure one or more decorative inserts in a first jacket and wherein said first jacket is configured to have a first jacket coupler;

a second earring base configured to secure one or more decorative inserts in a second jacket wherein said second jacket is configured to have a jacket attachment configured to be secured with said first jacket coupler and have a second jacket coupler;

a bracelet and a necklace;

at least one modular bracelet attachment comprising:

at least one bracelet coupler configured to be secured to said bracelet;

at least one bail configured to be capable of being secured around said bracelet coupler; and wherein said second jacket can be de-coupled from said first earring base and be coupled with said bail through said jacket attachment.

10. An interchangeable modular jewelry system as described in claim 9 wherein said first jacket coupler comprises an integral clasp.

11. An interchangeable modular jewelry system as described in claim 10 wherein said jacket attachment comprises integral hoop configured to be coupled with said integral clasp.

12. An interchangeable modular jewelry system as described in claim 11 wherein said one or more decorative inserts comprises a decorative insert selected from the group consisting of: a gemstone, a replica gemstone, a glass insert, a plastic insert, an ornament.

13. An interchangeable modular jewelry system as described in claim 9 wherein the bases of the first and second earrings are coupled in-series to form a linear modular earring.

14. An interchangeable modular jewelry system as described in claim 9 wherein said bracelet coupler comprises at least one bail groove and at least one bail stopper surface configured to secure said bail.

15. An interchangeable modular jewelry system as described in claim 14 and further comprising a bail lock.

16. An interchangeable modular jewelry system as described in claim 15 and further comprising a third jacket coupled with said second jacket through said second jacket coupler.

17. An interchangeable modular jewelry system as described in claim 16 wherein said third jacket is coupled in a series with said second jacket forming a linear modular bracelet attachment.

* * * * *